US005720477A

United States Patent [19]

Morita et al.

[11] Patent Number: 5,720,477

[45] Date of Patent: Feb. 24, 1998

[54] PAPER-FEEDING DEVICE

[75] Inventors: Yuukichi Morita; Yoshiki Saeki; Masaaki Yamashita; Mituhiro Yashiki; Hideaki Taniguchi; Nobuhisa Yamazaki, all of Kahoku-gun, Japan

[73] Assignee: PFU Limited, Ishikawa, Japan

[21] Appl. No.: 504,563

[22] Filed: Jul. 20, 1995

[30] Foreign Application Priority Data

| | | | |
|---|---|---|---|
| Jul. 20, 1994 | [JP] | Japan | 6-167808 |
| Nov. 29, 1994 | [JP] | Japan | 6-321295 |
| Feb. 28, 1995 | [JP] | Japan | 7-066825 |

[51] Int. Cl.[6] ..... A65H 3/06

[52] U.S. Cl. ..... 271/117; 271/114

[58] Field of Search ..... 271/10.03, 10.12, 271/110, 114, 117, 118, 126, 242, 152, 153

[56] References Cited

U.S. PATENT DOCUMENTS

| | | | |
|---|---|---|---|
| 4,394,009 | 7/1983 | Bergman et al. | 271/10.12 |
| 5,083,766 | 1/1992 | Osawa | 271/126 |
| 5,273,267 | 12/1993 | Neuyebauer | 271/10.03 |
| 5,346,199 | 9/1994 | Martin et al. | 271/117 |

FOREIGN PATENT DOCUMENTS

| | | | |
|---|---|---|---|
| 360244726 | 12/1985 | Japan | 271/110 |
| 0201736 | 9/1987 | Japan | 271/110 |
| 0203129 | 8/1989 | Japan | 271/110 |
| 0317923 | 12/1989 | Japan | 271/118 |

OTHER PUBLICATIONS

Beentes et al, IBM Technical Disclosure Bulletin, Picker Mechanism, Jun. 1973, vol. 16 No. 1 p. 63.

*Primary Examiner*—H. Grant Skaggs

*Attorney, Agent, or Firm*—Nikaido, Marmelstein, Murray & Oram LLP

[57] ABSTRACT

To provide a high-speed paper-feeding device for feeding slips or papers from the hopper by using a pick roller, featuring reduced misoperation, reduced noise, a higher paper-feeding speed and compactness. In the high-speed paper-feeding device, the bouncing motion of the pick roller that may take place at the beginning of the paper-feeding operation is suppressed by using a buffer device, the end portions only of the slips or the papers are pushed up/restored by a push-up device, that moves the arm up and down being driven by a solenoid that is provided at the bottom of the hopper, in order to reduce the burden for moving the hopper up and down born by the motor and the rack-and-pinion mechanism. Besides, the motion of the pick roller is detected at a moment when the rear end of the slip separates away from the pick roller to control the continuous feeding of the papers while eliminating dead time between the papers that are fed and enabling the papers to be continuously fed at high speed.

4 Claims, 16 Drawing Sheets

PAPER-FEEDING DEVICE

BACKGROUND OF THE INVENTION

1. Field of the Invention

The present invention relates to a high-speed paper-feeding device in an apparatus for continuously processing many slips or papers that are stacked, such as OCR apparatus, printer, image reader, copying machine, facsimile on the like apparatus. More specifically, the invention relates to an improved means for increasing the speed of feeding paper in a paper-feeding device of a type in which a number of slips or papers stacked on a hopper are drawn out and are fed one piece by one piece by a pick roller (feed roller).

2. Description of the Related Art

Described below is a conventional paper-feeding device employed in an OCR apparatus.

FIG. 18 is a diagram which schematically illustrates a pick unit in the paper-feeding device, wherein reference numeral 1 denotes a hopper, 2 denotes paper slips, 3 denotes a pick roller, 4 denotes a pad plate, 5 denotes a separator pad, 6 denotes a motor, 7 denotes a motor gear, 8 denotes an idler gear, 9 denotes a pick gear, 10 denotes a pick arm, 11 denotes a pick arm support shaft, and reference numeral 12 denotes a pick roller drive shaft.

The motor gear 7, idler gear 8 and pick gear 9 are coupled together and are driven by the motor. The pick roller 3 and the pick gear 9 are mounted on the pick roller drive shaft 12 provided at an end of the pick arm 10; i.e., the pick gear 9 and the pick roller 3 rotate together as a unitary structure. The pick arm 10 permits the pick roller 3 to swing up and down with the pick arm support shaft 11 as a fulcrum.

When the motor 6 is energized upon the start of an operation, the motor gear 7 rotates in the clockwise direction and causes the pick gear 9 to rotate in the clockwise direction via an idler gear 8. Since the pick gear 9 and the pick roller 3 are coupled together as a unitary structure, the pick roller 3 also rotates in the clockwise direction. The pick roller 3 has a relatively large coefficient of friction and is pressed onto the paper slips 2 stacked in the hopper 1. Accompanying the rotation of the pick roller 3 in the clockwise direction, therefore, the uppermost slip is drawn in the direction of the separator pad 5. At this moment, double feeding inclusive of the second slip is prevented owing to the frictional force between the separator pad 5 and the slip; i.e., only the uppermost slip is fed.

FIG. 19 is a perspective view illustrating in detail the pick unit shown in FIG. 18. As shown, an end of a pick unit pressure-adjusting spring 14 is attached to a spring-mounting plate 13 that is swingingly and pivotally attached to the pick arm support shaft 11, whereby a force is imparted to upwardly pull the whole pick unit to adjust the force with which the pick roller pushes the slip.

With the above-mentioned conventional paper-feeding device, when the paper feeding is set to a high speed, the pick roller 3 rotates at an increased speed. Therefore, the reaction becomes great at the beginning of rotation of the pick roller whereby the pick roller 3 jumps up, together with the pick arm 10, and the spring-mounting plate 13 fastened to the pick arm 10 comes to a halt upon colliding with the stopper 15 and returns back to the initial picking position creating a bouncing motion, and, hence, causing the problems of (1) miss picking and (2) the generation of noise.

As shown in FIG. 20(*a*), furthermore, the paper-feeding device is equipped with a motor 16*a* for moving the hopper 1 up and down and a rack-and-pinion mechanism 16*b*. As shown in FIG. 20(*b*), first, the hopper 1 is moved up until the uppermost slip 2 of the stack comes into contact with the lower part of the pick roller 3. Then, the uppermost slip 2 is drawn as shown in FIG. 20(*c*), and the hopper 1 is moved down at a moment when the slip is inserted between the pick roller 3 and the separator pad 5. This is to prevent double feeding in which the subsequent slips stacked on the hopper 1 are drawn out successively by the pick roller 3; i.e., to separate the rest of the stacked slips away from the pick roller 3. However, an extended period of time is needed for moving the hopper 1 up and down for every feeding of the slip, and the time for moving the hopper up and down must be shortened in order to feed the papers at a high speed.

Therefore, a large motor that produces a large torque has been used to move the heavy hopper up and down at high speed, causing the device to become bulky.

Furthermore, when many slips are continuously fed by the pick unit as shown in FIG. 21(*a*), a slip 2 drawn from the hopper 1 by the pick roller 3 is carried by a carrier roller 17, and the feeding of a next slip by the pick roller 3 is started after the rear end of the slip 2 is detected by a rear end sensor 18 and after the passage of the rear end of the slip through a predetermined portion is confirmed. In fact, however, the feeding of the next slip can be readily started after the rear end of the slip separates from the pick roller 3. Therefore, the deviation time caused by the detection of the rear end turns out to be a dead time among the slips that are sequentially fed. It has therefore been attempted to install the rear end sensor 18 at a position as close to the pick roller 3 as possible but this is accompanied by a limitation. When a reflection-type optical sensor is used as the rear end sensor 18, in particular, any black region that has been pre-printed on the slip may be erroneously recognized as the rear end of the slip. Usually, therefore, a margin of about 30 mm is provided, and the feeding of the next slip is not started even when the rear end is detected by the reflection-type optical sensor until the slip is further moved by the section of 30 mm without detecting the slip again, resulting in extra dead time. FIG. 21(*b*) illustrates an operation sequence, wherein ① represents the slip-feeding period and wherein dead time is from a moment t0 at which the rear end of the slip separates away from the pick roller until a moment t1 at which the feeding of the next slip is started. This dead time is the sum of a delay time until the rear end of the slip is detected by the rear end sensor (see ②) and of a time until the passage of a margin (see ③) that is set for preventing erroneous recognition caused by pre-printing.

SUMMARY OF THE INVENTION

A primary object of the present invention is to provide a high-speed paper-feeding device for feeding slips or papers in a hopper by using a pick roller, the high-speed paper-feeding device being free from erroneously operating, producing less noise, being capable of feeding papers at high speeds and being compact.

According to a first aspect of the present invention, there is provided a paper-feeding device which feeds slips or papers stacked on a hopper by drawing them one by one at a high speed and by a pick roller, from the uppermost position, characterized by the provision of a buffer means which stops the pick roller from bouncing when the feeding of paper is started.

Preferably, the buffer means may be an air damper. Further, the buffer means may be constituted by a stopper that limits the range of the swing of the pick roller and an impact relieving member that engages with said stopper.

According to a second aspect of the present invention, there is provided a paper-feeding device which feeds slips or papers stacked in a hopper equipped with an elevator mechanism by drawing them one by one position, at a high speed and by a pick roller; from the uppermost sheet, characterized by the provision of a push-up means having an arm which swings upwards, being driven by a drive means under the pick roller of the hopper, in order to push up an end of the slip or the paper stacked in the upper part.

Preferably, the drive means may be a solenoid. Further, preferably, the drive means may be constituted by a motor and a cam rotated by the motor.

According to a third aspect of the present invention, there is provided a paper-feeding device which feeds slips or papers stacked on a hopper by drawing them one by one, at a high speed and by a pick roller, from the uppermost sheet, characterized by the provision of a picking position detecting means which, after the feeding of paper is started by the picking roller, detects the time at which the pick roller that has swung upwardly returns back to the lower side, in order to control the feeding of the next slip or the paper by relying upon an output from said detecting means.

According to a fourth aspect of the present invention, there is provided a paper-feeding device having a pick roller that rotates in contact with the surface of a paper to impart frictional feeding force to the paper and a separator pad that imparts a frictional resistance force to the paper that passes and is urged toward the pick roller, said pick roller and said separator pad being supported by a pick arm which swings up and down, characterized in that said pick arm is provided with an elastically displacable vibration-absorbing pad that comes into contact therewith from the upper side, and provision is made of a normal mode in which the pick roller is rotated at a first setpoint speed in a state where the vibration-absorbing pad is separated away therefrom and a high-speed mode in which the pick roller is rotated at a second setpoint speed which is faster than the first setpoint speed in a state in which the vibration-absorbing pad is brought into contact with the pick arm.

Preferably, provision may be made of a hopper that moves up and down with the papers being stacked thereon, the vibration-absorbing pad is provided at a predetermined position, and the hopper is elevated by a setpoint amount beyond the position in the normal mode, so that the pick arm is moved upwards to come into contact with the vibration-absorbing pad.

Further, preferably, provision may be made of a hopper that moves up and down with the papers being stacked thereon, and a separator pad mounted on a pad plate that is upwardly urged by a spring, wherein provision is made of a pad push-down member which comes into contact with the pad plate from the upper side to downwardly urge the pad plate when the hopper is further elevated beyond the position in the high-speed mode.

According to a fifth aspect of the present invention, there is provided a paper-feeding device having a pick roller that rotates in contact with the surface of a paper to impart frictional feeding force to the paper and a separator pad that imparts frictional resistance force to the paper that passes toward the pick roller, said separator pad being mounted on a pad plate that is urged by a spring toward the side of the pick roller, wherein provision is made of a resistance means which resist quick motion of the pad plate in the retracting direction.

Preferably, said resistance means may be an elastic vibration-absorbing pad that comes into contact with the back surface of the pad plate. Further, preferably, the pad plate may be pivotally attached to swing about a fulcrum pin, and said resistance means is a highly viscous lubricating material that is imparted to the pivoted portion.

According to a sixth aspect of the present invention, there is provided a paper-feeding device having a pick roller that rotates in contact with the surface of a paper to impart frictional feeding force to the paper, a separator pad that imparts frictional resistance force to the paper that passes being urged toward the peripheral surface of the pick roller, and skew correction rollers which nip and feed the paper that is fed on the downstream side of the pick roller and the separator pad, wherein a guide member that guides the paper between the pick roller 3 and the skew correction rollers is provided with a buffer member that comes into contact with the surface of the paper when it is stretched between the pick roller and the skew correction rollers.

According to a seventh aspect of the present invention, there is provided a paper-feeding device in which a pick roller is mounted on a pick arm that swings up and down about a pick arm support shaft, wherein provision is made of a drive motor that rotates the pick roller at a high speed and a bound-back stopper which downwardly repels the upward motion of the pick arm supporting the pick roller at a position at which the pick roller is moved slightly upwards and beyond a predetermined paper-feed position.

Preferably, the bounce-back stopper may have an elastic material such as rubber at a portion where it comes into contact with the pick arm. Further, preferably, the bounce-back stopper may be provided at such a position as to substantially come into contact with the pick arm to resiliently return it when the pick roller is moved up by 0.1 to 0.8 mm beyond the normal paper-feed position. Preferably, it may comprise a high-speed setpoint means for setting the running speed of the pick roller when it rotates at a high speed, a low-speed setpoint means (27) for setting the running speed of the pick roller when it rotates at a low speed, and a switching means for switching the two setpoint values.

According to an eighth aspect of the present invention, there is provided a paper-feeding device in which a pick roller is mounted on a pick arm that swings up and down about a pick arm support shaft, wherein provision is made of a balancing arm which extends toward the side opposite to the pick roller with the pick arm support shaft of the pick arm as a center, and a balancing weight is attached to the balancing arm.

According to a ninth aspect of the present invention, there is provided a paper-feeding device in which a pick roller is mounted on a pick arm that swings up and down about a pick arm support shaft, wherein provision is made of a magnet on the pick arm or on a member which is formed substantially integrally with the pick arm, and a fixed magnet on a stationary member opposed to said magnet, said fixed magnet attracting or repelling said magnet.

According to a tenth aspect of the present invention, there is provided a paper-feeding device having a pick roller which gives a frictional feeding force to the paper and a separator pad which is resiliently pressed onto the peripheral surface of the pick roller, wherein provision is made of a vibration-suppressing means for suppressing vibration of the separator pad or of a pad plate that supports the separator pad.

Preferably, said vibration-suppressing means may be a damper member stuck to the pad plate.

According to an eleventh aspect of the present invention, there is provided a method of feeding paper in an automatic paper-feeding device in which a pick roller is mounted on a pick arm that swings up and down about a pick arm support shaft, wherein provision is made of a bounce-back stopper which comes into contact with the pick arm pick roller and is moved slightly up beyond the normal paper-feed position to limit its upward motion, and when paper misfeed occurs at the normal paper-feed position, a hopper is slightly moved up beyond the position at which the pick roller is prevented by said bounce-back stopper from moving up, so that the peripheral surface of the pick roller is locally elastically deformed upon coming into contact with the paper, and the pick roller is rotated again to effect a re-try operation.

According to a twelfth aspect of the present invention, there is provided a method of feeding paper in an automatic paper-feeding device in which a pick roller stops rotating in a state where the leading end of a paper fed by the pick roller is brought into contact with a nipping portion of a skew correction roller so that the paper is slightly deflected and, then, the skew correction roller is rotated to feed the paper while correcting the skew thereof, wherein the pick roller is rotated in synchronism with the skew correction roller for only a very short period of time when the skew correction roller is to be rotated after the pick roller has been stopped.

DESCRIPTION OF THE PREFERRED EMBODIMENTS

A first embodiment according to the present invention will now be described with reference to FIGS. 1(*a*), 1(*b*), and 1(*c*).

Figure 1A:
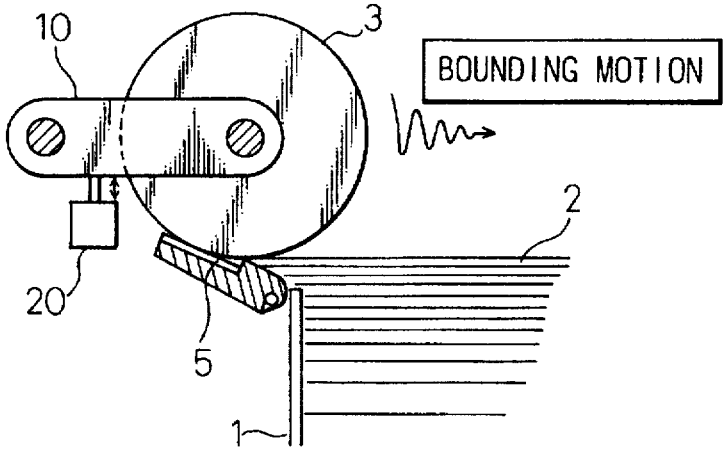
FIGS. 1(*a*), 1(*b*), and 1(*c*) are views showing a first embodiment of the present invention.
Figure 1B:
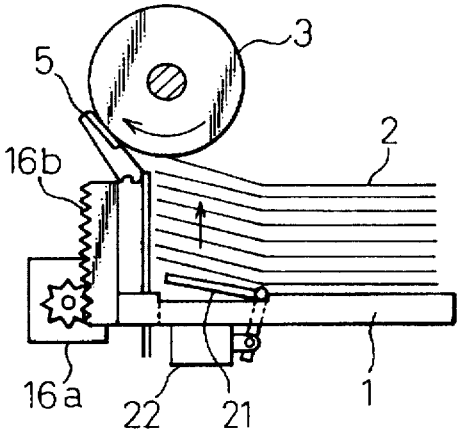

FIG. 1(*a*) illustrates a constitution having a buffer means for suppressing the bouncing motion of the pick roller, wherein reference numeral 1 denotes a hopper, 2 denotes slips or papers (hereinafter simply referred to as slips), 3 denotes a pick roller, 5 denotes a separator pad, 10 denotes a pick arm, and reference numeral 20 denotes a buffer means having a damping action. The operation is as described below.

When the feeding of paper is started, the lower part of the pick roller 3 comes into contact with the uppermost slip 2 stacked on the hopper 1 and is rotated in the clockwise direction. At this moment, the pick roller 3 jumps up due to the reaction produced with respect to the slip 2. However, the bounding motion that would occur is suppressed by the buffer means 20; i.e., the bounding motion is attenuated and stable state is assumed quickly.

According to the constitution of FIG. 1(*a*), even when the pick roller 3 is rotated at a high speed to feed the papers at a high speed, the occurrence of bouncing is suppressed by the buffer means and the paper-feeding operation is stably carried out, making it possible to realize a high-speed paper-feeding device that permits less misfeeding and generates less noise than those of the conventional devices.

FIG. 1(*b*) illustrates a push-up means for pushing up only the end of the slip on the hopper, wherein reference numeral 1 denotes a hopper, 2 denotes slips, 3 denotes a pick roller, 5 denotes a separator pad, 10 denotes a pick arm, 16*a* denotes a motor, 16*b* denotes a rack-and-pinion mechanism, 21 denotes an arm of the push-up means provided at the bottom of the hopper 1 under the pick roller 3, and reference numeral 22 denotes a solenoid for swinging the arm 21.

At a time when the feeding of paper is to be started by the pick roller 3, the solenoid 22 is driven and the arm 21 swings up. Then, the arm 21 pushes up the left ends only of the slips 2 stacked on the hopper as shown, and the uppermost slip 2 is pushed to the lower part of the pick roller 3. The paper is now ready to be fed by the pick roller 3. In this case, the push-up mechanism constituted by the motor 16*a* and the rack-and-pinion mechanism 16*b* produces a principal function for compensating for a change in the amount of the slips 2 that are stacked. After the uppermost slip 2 is inserted into between the pick roller 3 and the separator pad 5, the solenoid 22 is de-energized, the arm 21 is restored, and the slips of which the left ends had been lifted up return to the initial flat state.

According to the constitution of FIG. 1(*b*), the arm 21 and solenoid 22 need push up only portions of the slips 2 that are stacked on the hopper 1. Therefore, the device is small and is capable of feeding the papers at high speeds. Therefore, the high-speed paper-feeding device can be realized in a small size and at a reduced cost.

Figure 1C:
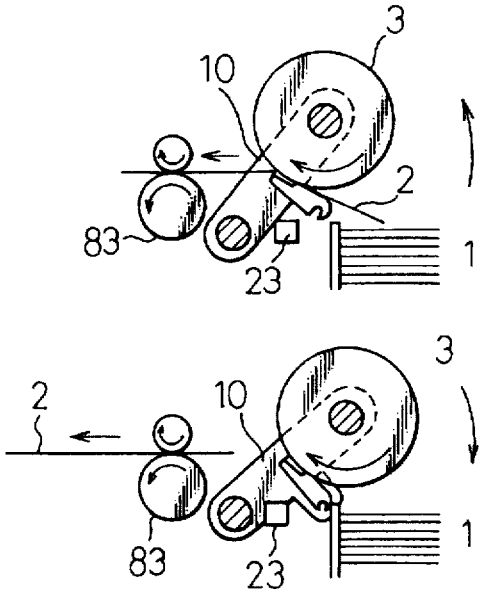

FIG. 1(c) illustrates a constitution for continuously feeding the papers by providing a means that detects the motion of the pick roller at the moment when the rear end of the slip separates away from the pick roller, and wherein reference numeral 1 denotes a hopper, 2 denotes a slip, 3 denotes a pick roller, 5 denotes a separator pad, 10 denotes a pick arm, 83 denotes a skew correction roller, and reference numeral 23 denotes a pick position sensor for detecting the motion of the pick roller.

At a moment when the slip 2 is drawn out from the hopper 1 by the pick roller 3 and is sent onto the skew correction roller 83, the rear end of the slip 2 still remains sandwiched between the pick roller 3 and the separator pad 5. At this moment, the carrier speed of the skew correction roller 83 is greater than the paper-feeding speed by the pick roller 3 and, hence, the pick roller 3 attached to an end of the pick arm 10 is pulled toward the side of the skew correction roller 83, whereby the pick roller 3 swings in the counterclockwise direction with the other end of the pick arm 10 as a fulcrum. This motion is detected by the pick position sensor 23 provided for the pick arm 10. Then, the rear end of the slip 2 separates away from the pick roller 3 as the slip 2 is further advanced by the skew correction roller 83. Therefore, the force of swinging the pick roller 3 in the counterclockwise direction is lost, and the pick roller 3 is returned in the clockwise direction. This motion is detected by the pick position sensor 23, and the operation for feeding the next slip is controlled by the output thereof.

According to the constitution of FIG. 1(c), the moment at which the rear end of the slip 2 that is being fed is separated away from the pick roller 3 is readily detected by the pick position sensor 23, enabling the next slip to be fed early, making it possible to eliminate dead time when continuously feeding the papers and to realize a high-speed paper-feeding device.

Figure 2A:
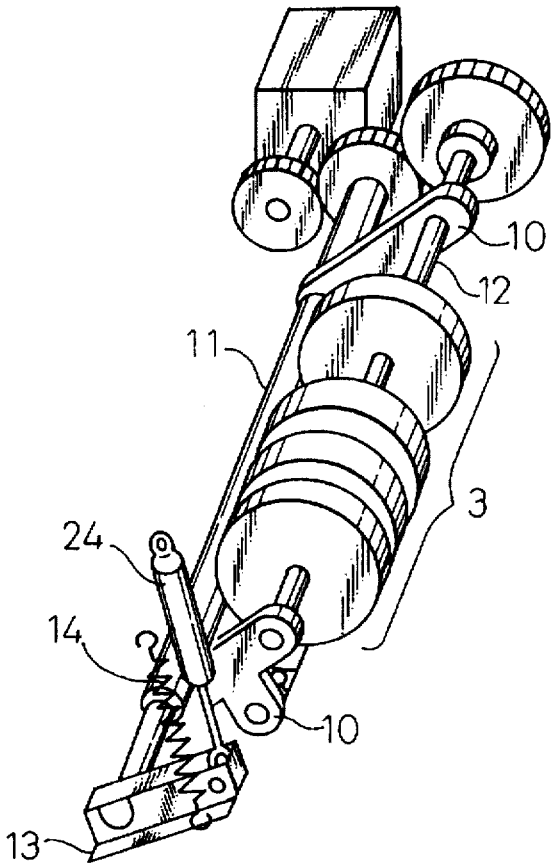
FIGS. 2(*a*) and 2(*b*) are views showing a second embodiment of the present invention.
Figure 2B:
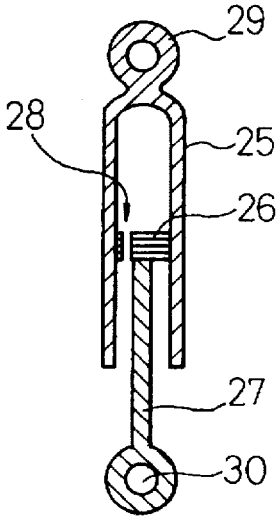
Figure 19:
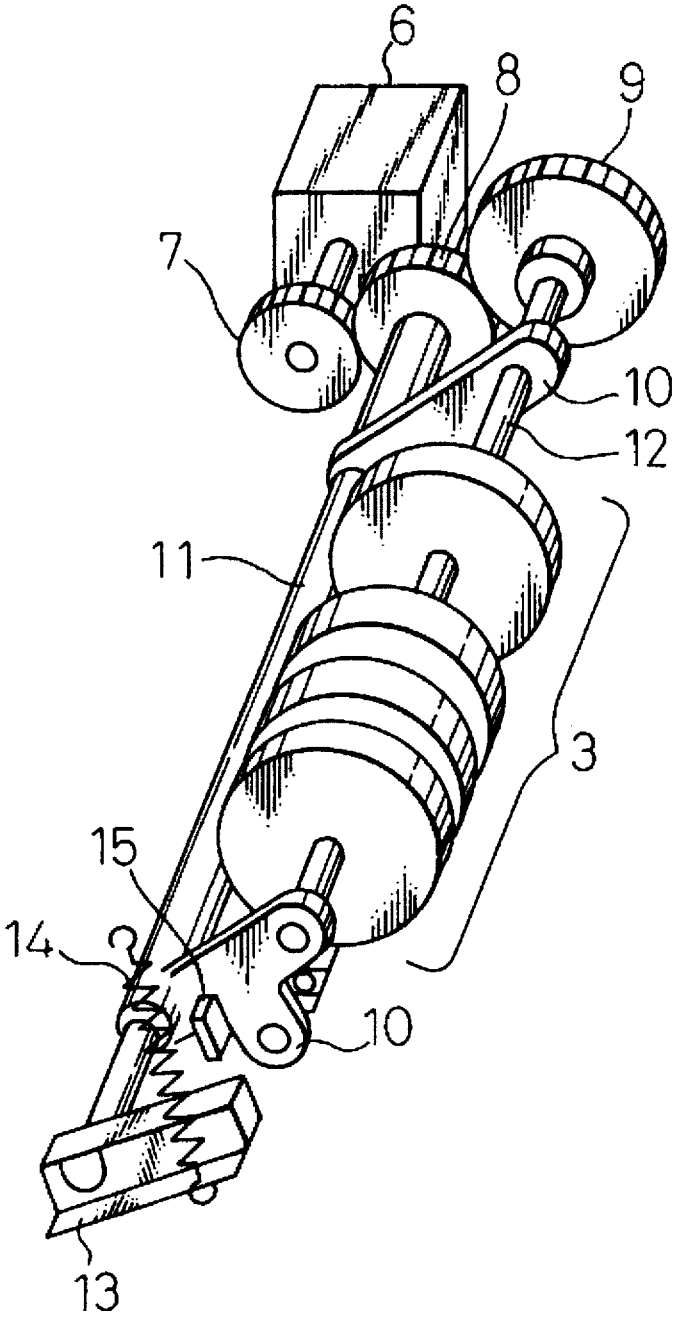
Fig.19 (PRIOR ART)
FIG. 19 is a perspective view of a conventional pick unit.
Figure 20A:
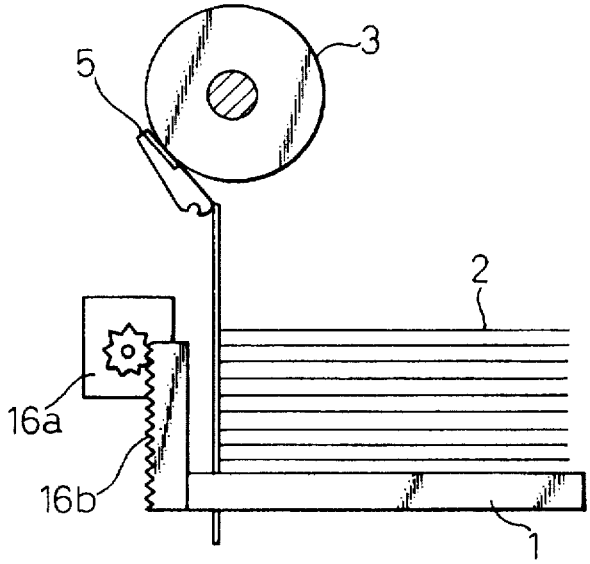
Fig.20(a) (PRIOR ART)
FIG. 20(*a*), 20(*b*), and 20(*c*) are views illustrating a conventional mechanism for moving the hopper up and down.
Figure 20B:
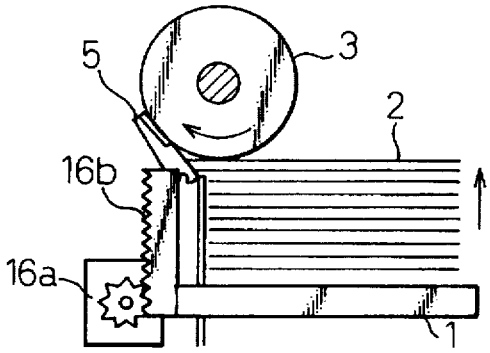
Fig.20(b) (PRIOR ART)
Figure 20C:
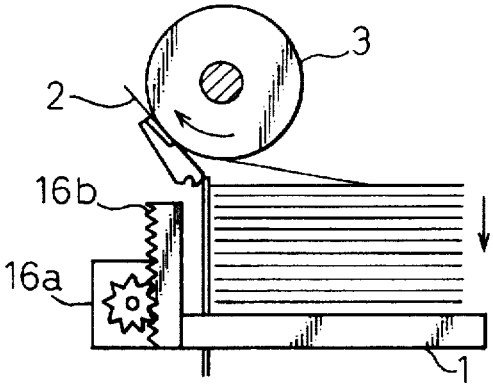
Fig.20(c) (PRIOR ART)
Figure 21A:
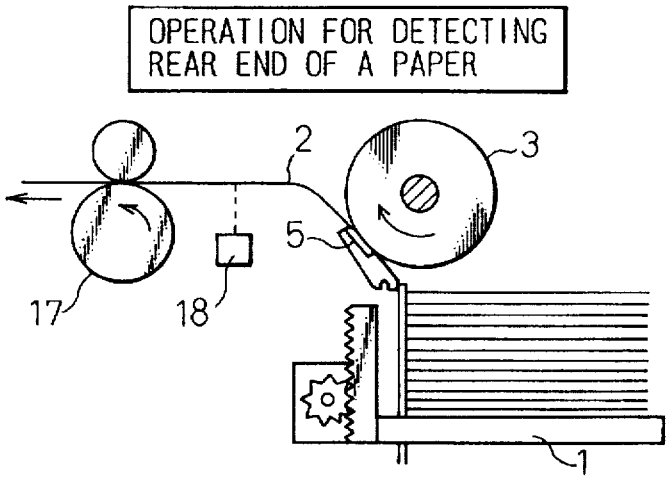
Fig.21(a) (PRIOR ART)
FIGS. 21(*a*) and 21(*b*) are views illustrating a conventional continuous paper-feed control operation.
Figure 21B:
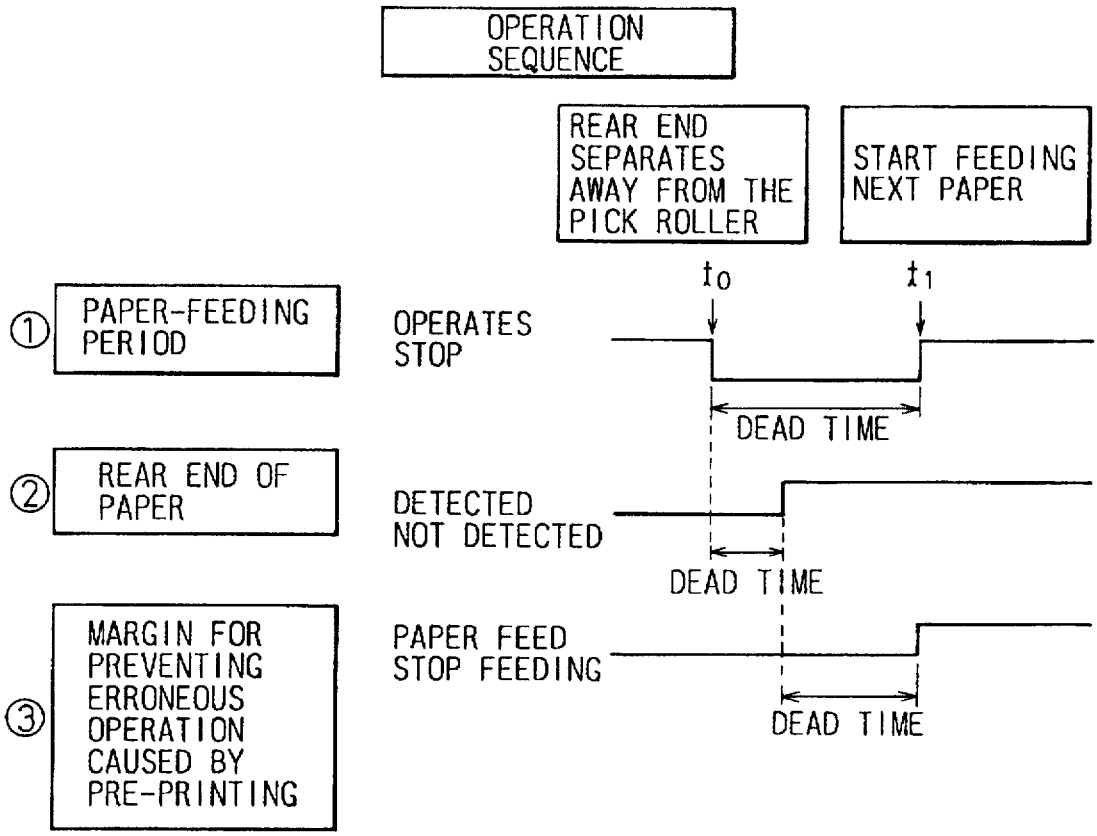
Fig.21(b) (PRIOR ART)

FIG. 2(a) and 2(b) illustrate a second embodiment according to the present invention, wherein an air damper is used as a buffer means, the embodiment being an improvement on the pick unit in the conventional device shown in FIG. 19. Therefore, the constituent portions that are not changed are denoted by the same reference numerals as those of FIG. 19 and to which can be applied the description of FIG. 19.

Referring to FIG. 2(a), the pick roller 3 is swingingly mounted on the pick arm support shaft 11 via the pick roller drive shaft 12 and pick arms 10. To the pick arm support shaft 11 is secured a spring-mounting plate 13 on which is mounted a pick unit pressure-adjusting spring 14. Therefore, the spring-mounting plate 13 swings together with the pick rollers 2. In this embodiment, an air damper 24 is attached to an end of the spring-mounting plate 13.

FIG. 2(b) is a sectional view of the air damper 24, wherein reference numeral 25 denotes a cylinder, 26 denotes a piston, 27 denotes a piston rod, 28 denotes an aperture which permits a small amount of gas to flow in or out between the interior and the exterior of the cylinder when the piston 26 is driven, 29 denotes a mounting hole through which the damper can be pivoted by a pin to the frame (not shown) and reference numeral 30 denotes a mounting hole through which the damper can be pivoted by a pin to an end of the spring-mounting plate 13 of FIG. 2(a).

At the start of feeding the paper, when the pick roller 3 is caused to rapidly swing so as to undergo bounding motion, the spring-mounting plate 13 swings simultaneously so as to drive the piston 26 in the air damper 24. However, the motion of the piston 26 is limited by a gaseous pressure in the cylinder 25 and is changed into a slower motion depending upon the amount of the gas that flows in and out through the aperture 28 in the piston 26. The air damper 24 exhibits a large frictional resistance against quick motion and further works as a delay element. Therefore, the bounding energy or vibration energy of the pick roller 3 is absorbed by the air damper 24, and the operation of the pick roller 3 is stabilized.

Figure 3:
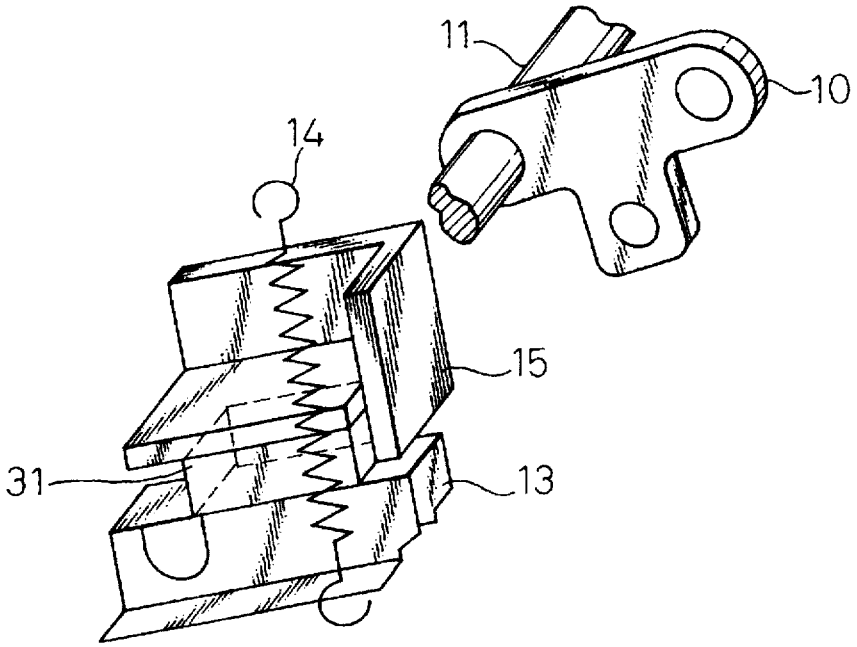
FIG. 3 is a diagram illustrating the device according to a third embodiment of the present invention.

FIG. 3 illustrates a third embodiment according to the present invention, wherein an impact absorbing member is used as the buffer means. The fundamental constitution of this embodiment is the same as that of the case of FIG. 2(a). Therefore, FIG. 3 illustrates improved portions only.

In FIG. 3, reference numeral 10 denotes a pick arm, 11 denotes a pick arm support shaft, 13 denotes a spring-mounting plate, 14 denotes a pick unit pressure-adjusting spring, 15 denotes a stopper fitted to the frame, and reference numeral 31 denotes an impact relaxing member. As described above, the spring-mounting plate 13 swings together with the pick roller 3 (not shown) but is limited for its swinging range by the stopper 15. In this embodiment, an impact absorbing member (e.g., SOLBCEIN: a registered trademark) 31 is attached to the upper surface of the spring-mounting plate 13 that engages with the stopper 15 or to the lower surface of the stopper 15, in order to absorb the energy when the spring-mounting plate 13 comes into violent collision with the stopper 15 causing bouncing of the pick roller 3.

The impact absorbing member 31 is a resilient material having a low hardness but a large viscosity against suddenly changing forces. Therefore, the bouncing motion of the pick roller 3 is quickly attenuated, making it possible to prevent mispicking or generation of noise. In a state where the pick roller 3 is stably rotating, the pick pressure is not affected since the impact absorbing member 31 has a low modulus of elasticity.

Figure 4A:
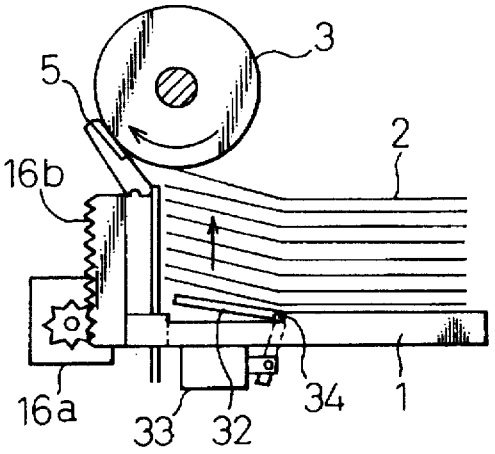
FIGS. 4(*a*) and 4(*b*) are views showing a fourth embodiment of the present invention.
Figure 4B:
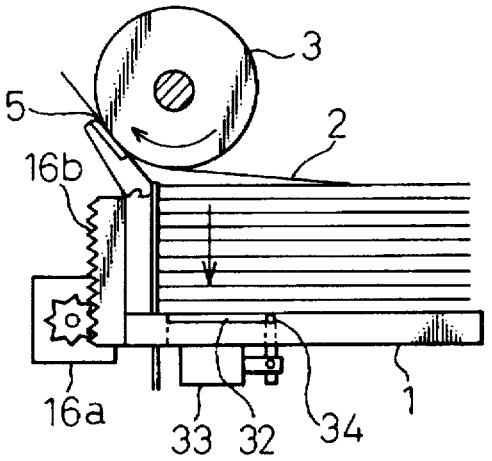

FIGS. 4(a) and 4(b) illustrate a fourth embodiment, according to the present invention, which is provided with a push-up means at the bottom of the hopper to quickly push up the end portions of the slips, and wherein reference numeral 1 denotes a hopper, 2 denotes slips, 3 denotes a pick roller, 5 denotes a separating pad, 16a denotes a motor for moving the hopper up and down, 16b denotes a rack-and-pinion mechanism, 32 denotes a swing arm for pushing-up, 33 denotes a solenoid for driving the arm, and reference numeral 34 denotes a fulcrum about which the arm swings.

FIG. 4(a) illustrates a state where the slip that is pushed up is brought into engagement with the pick roller 3 at the time when the paper-feeding is started by the pick roller 3, and FIG. 4(b) illustrates a state where the remaining slips escape after the uppermost slip is drawn by the pick roller 3.

In FIG. 4(a), the solenoid 33 is driven at a moment when the paper-feeding operation is started by the pick roller 3. Accordingly, the arm 32 swings upwards with the fulcrum 34 as a center, whereby the left ends of the slips 2 stacked thereon are pushed up together, and the uppermost slip 2 is brought into engagement with the lower part of the pick rollers 3 so as to be fed. The motor 16a and the rack-and-pinion mechanism 16b effect an up and down motion to compensate for a change in the total thickness of the slips stacked on the hopper 1.

After the uppermost slip 2 on the hopper 1 is drawn out by a predetermined distance by the pick roller 3, the solenoid 33 is de-energized and the arm 32 returns to the initial position as shown in FIG. 4(b). Accordingly, the left ends of the slips that had been pushed up by the upper part of the arm become flat, the uppermost slip is disengaged from the lower part of the pick roller 3, and double feeding does not take place.

Figure 5A:
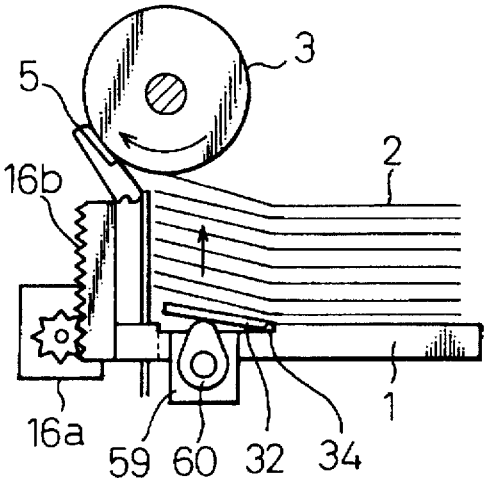
FIGS. 5(*a*) and 5(*b*) are views showing a fifth embodiment of the present invention.
Figure 5B:
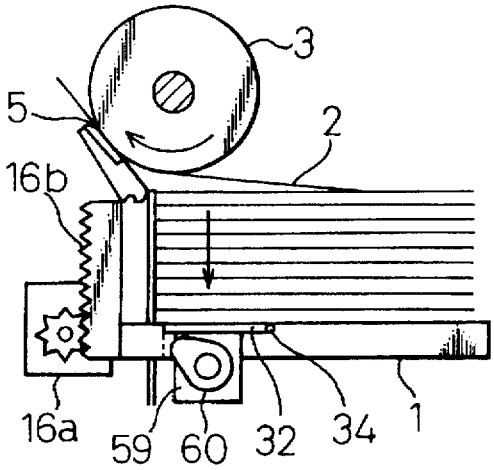

FIGS. 5(*a*) and 5(*b*) illustrate a fifth embodiment according to the present invention, wherein a motor cam is used instead of the solenoid of FIG. 4. In FIG. 5, reference numeral 59 denotes a motor and 60 denotes a cam.

FIG. 5(*a*) illustrates a state where the feeding of paper is started by the pick roller 3. The motor 59 is driven to rotate the cam 60, for example, in the clockwise direction, and the arm 34 is pushed up from the lower side by the large-diameter portion of the cam 60 and is stopped. Therefore, the arm 34 swings upwards, the left ends of slips 2 stacked on the arm 34 are pushed up together, and the uppermost slip 2 is brought into engagement with the lower part of the pick roller 3 as shown and is drawn out accompanying the rotation of the pick roller 3.

FIG. 5(*b*) illustrates a state immediately after the feeding of paper is started. The motor 59 is driven again when the slip is drawn out a predetermined distance, the short-diameter portion of the cam 60 is brought into engagement with the arm 34 to lower the arm 34, and the remaining slips 2 are permitted to escape downwards.

Figure 6A:
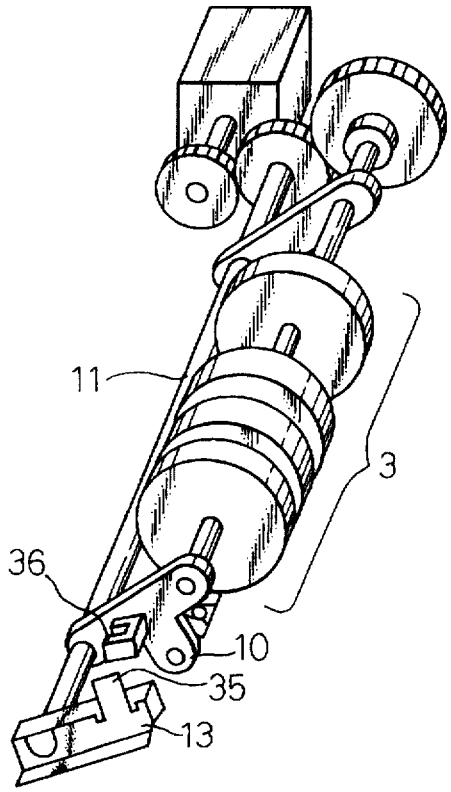
FIGS. 6(*a*) and 6(*b*) are views showing a sixth embodiment of the present invention.
Figure 6B:
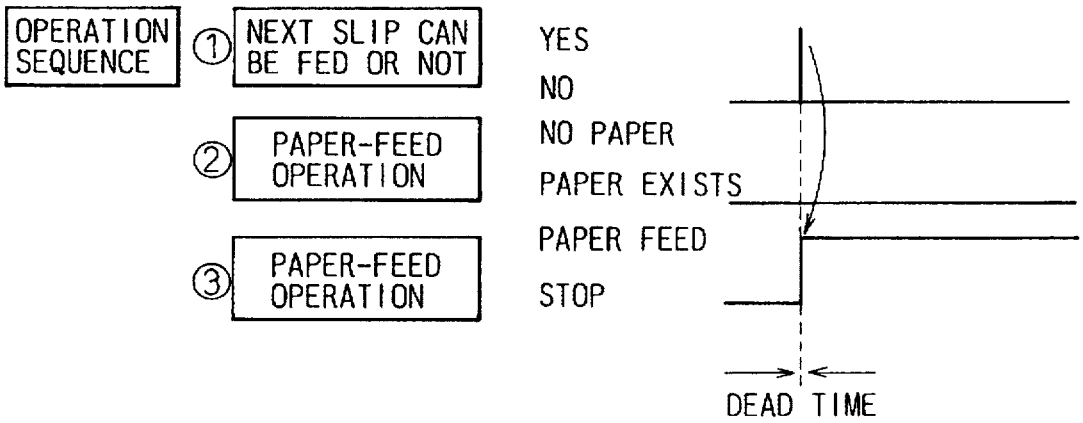

FIGS. 6(*a*) and 6(*b*) illustrate a sixth embodiment, according to the present invention, wherein a pick position sensor is used for detecting the rear end of the slip relying upon the motion of the pick roller. In FIG. 6(*a*), reference numeral 3 denotes a pick roller, 10 denotes a pick arm, 11 denotes a pick arm support shaft, 13 denotes a spring-mounting plate on which the pick unit pressure-adjusting spring is mounted, 35 denotes a sensor action piece which protrudes beyond the side surface of the spring-mounting plate 13, and reference numeral 36 denotes a sensor which is secured to the frame or the like to detect the sensor action piece 35. The sensor action piece 35 and the sensor 36 constitute the pick position sensor.

The pick roller 3 and pick arms 10 shown in FIG. 6(*a*) swing up from the diagramed position when the slip is drawn by the carrier roller as explained in FIG. 1(*c*). Accordingly, the sensor action piece 35 engages with the sensor 36 which then detects the upwardly swung state of the pick roller 3. Next, as the slip is further carried forward and its rear end separates away from the pick roller 3, the pick roller 3 and the pick arms 10 swing down whereby the sensor action piece 35 disengages from the sensor 36. This timing is detected by the sensor 36, and the feeding of the next slip is started.

FIG. 6(*b*) illustrates the operation sequence wherein (1) represents a time at which the rear end of the paper is detected by the sensor 36 and the operation for feeding the next slip is readily started as shown in (3). The time (2) is the time at which the rear end is detected by the conventional rear end sensor 18 shown in FIG. 11(*a*), and is obviously delayed from the time at which the rear end is detected by the sensor 36.

Figure 7:
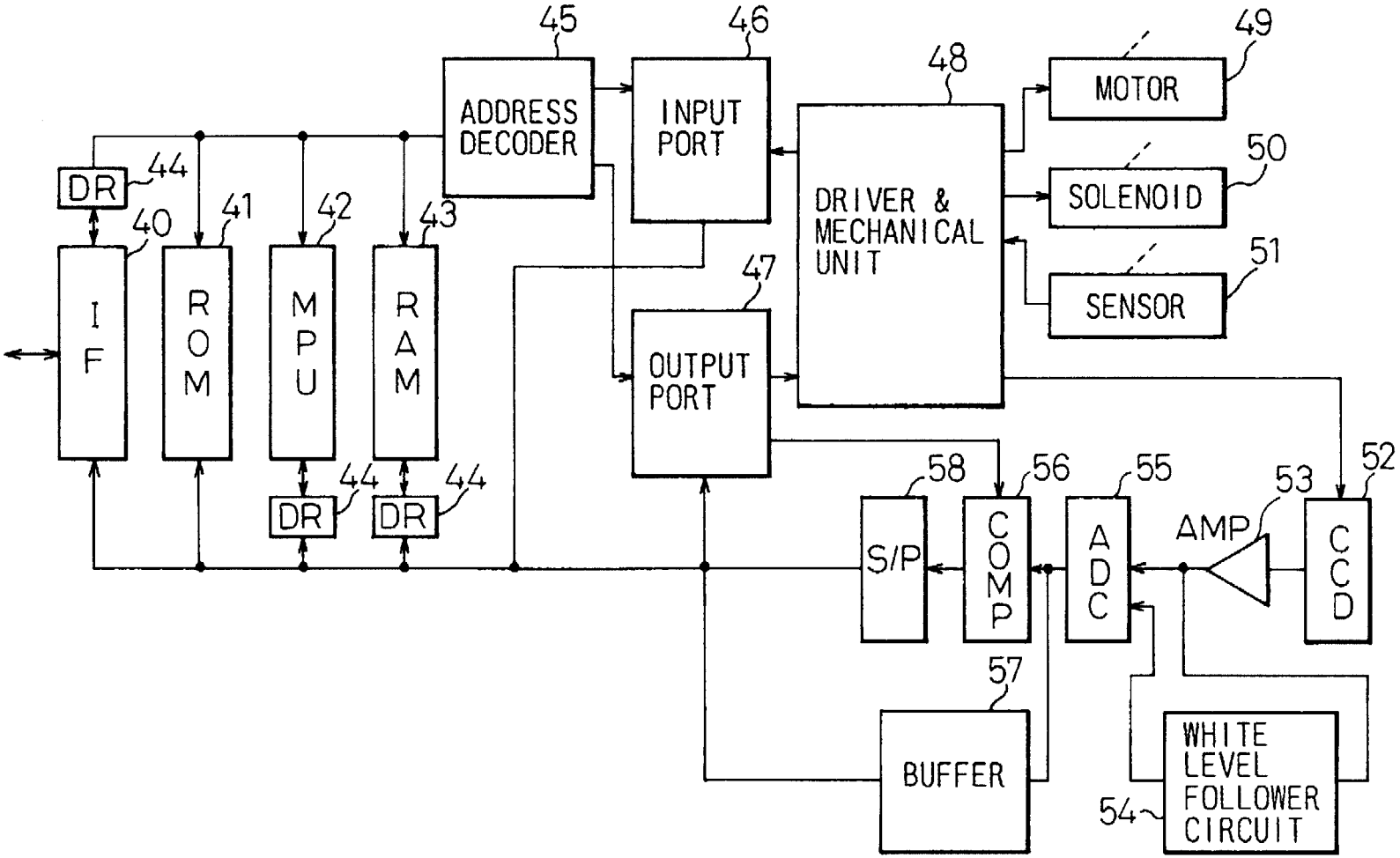
FIG. 7 is a block diagram of the device according to a seventh embodiment of the present invention.

FIG. 7 is a block diagram of a seventh embodiment, according to the present invention, illustrating the constitution of an image reader to which an embodiment of the present invention is adapted.

Figure 11A:
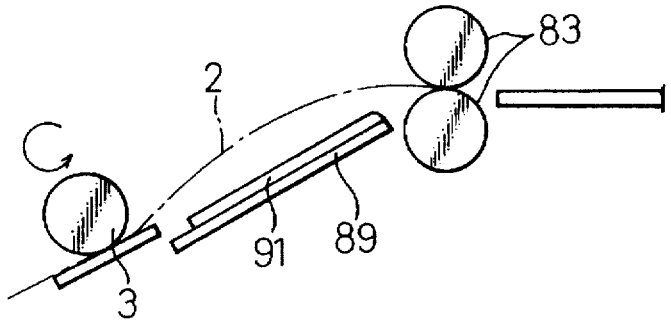
FIGS. 11(*a*) and 11(*b*) are side views showing a tenth embodiment, wherein FIG. 11(*a*) is a view illustrating a state in which the paper is deflected, and FIG. 11(*b*) is a view illustrating a state in which the paper is stretched.
Figure 11B:
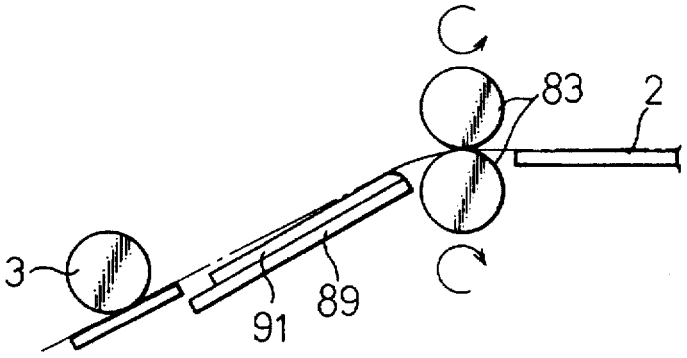

In FIG. 7, reference numeral 40 denotes an interface for sending and receiving data to and from a host unit, 41 denotes a ROM in which are stored control programs and control data, 42 denotes an MPU, 43 denotes a RAM in which are stored operation data, 44 denotes a bus driver, 45 denotes an address decoder for I/O control, 46 denotes an input port, 47 denotes an output port, 48 denotes a driver and a mechanical unit, 49 denotes a group of motors for driving the mechanism inclusive of a carrier (reader unit) feed motor, a motor 16*a* for moving the hopper up and down shown in FIG. 4, etc., reference numeral 50 denotes a group of solenoids for driving the mechanism, such as solenoid 33, etc., 51 denotes a group of sensors inclusive of sensor 36 of FIG. 6 and rear end sensor 18 of FIG. 11, reference numeral 52 denotes a CCD for reading image, 53 denotes an amplifier for amplifying CCD output video signals, 54 denotes a white level follower circuit for properly correcting the white level of video signals following the white level of the input image, 55 denotes an AD converter for converting analog video signals into digital multi-value image data, 56 denotes binary circuit for converting multi-value image date into binary data, 57 denotes a buffer for holding multi-value data, and reference numeral 58 denotes a series-parallel converter.

The MPU 42 executes the control program of the ROM 41, controls the motor and solenoid of the high-speed paper-feeding device as shown in FIG. 2(*a*), detects the state using the sensor so that the slip is fed from the hopper and is read by the CCD 52. The data of reading are once stored in the RAM 43 or in the buffer 57 and are sent to the host unit.

According to the high-speed paper-feeding device of the present invention, papers can be continuously fed at high speeds by using a relatively small motor making it possible to decrease dead time, misfeeding, noise, and, hence, to realize a device which is produced at a low cost having improved performance and reduced size.

Figure 8A:
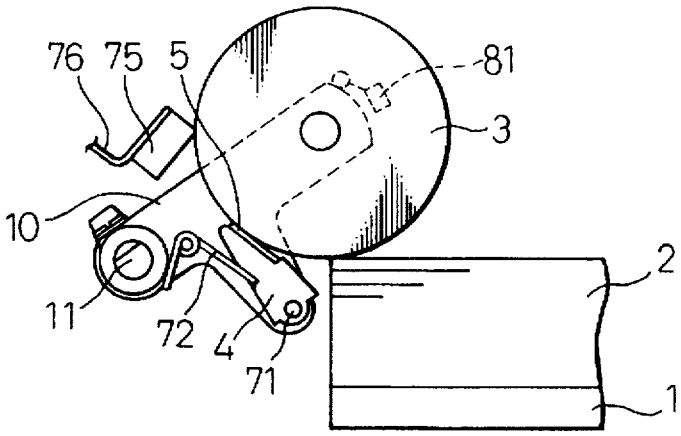
FIGS. 8(*a*), 8(*b*), and 8(*c*) are side views showing major portions of a eight embodiment, wherein FIG. 8(*a*) is a view illustrating the normal mode, FIG. 8(*b*) is a view illustrating the high-speed mode, and FIG. 8(*c*) is a view illustrating the state of re-trying operation.
Figure 8B:
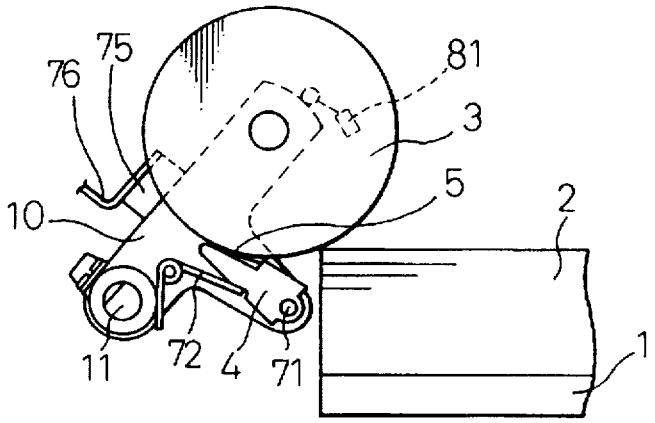
Figure 8C:
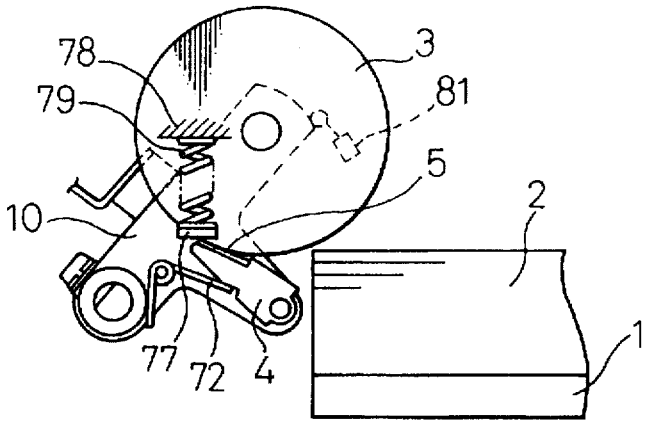

FIGS. 8(*a*), 8(*b*), and 8(*c*) illustrate an eighth embodiment according to the present invention. The stacked papers 2 are mounted on the hopper 1 that is moved up and down by a mechanism that is not shown, and the pick roller (paper-feed roller) 3 is provided being in contact with the upper surface at the leading end of the paper 2. The pick roller 3 is pivoted to the end of the pick arm 10 that swings about a pick arm support shaft 11, and is rotated in the clockwise direction in the drawing by a drive mechanism that is not shown.

The pad plate 4 is pivoted to swing about a fulcrum pin 71 under a portion of the pick arm 10 where the pick roller 3 is supported by the shaft 12, and is urged by a cylindrically coiled spring 72 toward the peripheral surface of the pick roller 3. The separator pad 5 is mounted at a portion coming into contact with the peripheral surface of the pick roller 3. A paper end sensor (not shown) for detecting the passage of the paper is provided at a position on the downstream side of the paper passage along an extension of the separator pad 5 that is in contact with the pick roller 3.

Above the pick arm 10, a vibration-absorbing pad 75, made of a block of a soft urethane foamed product, which is in contact with the upper edge of the pick arm 10 is provided being fastened to a stationary member such as a bracket 76 mounted on the device frame. A member that extends to the side (toward the back of the paper in the drawing) is provided at the end of the pad plate 4, and a pad push-down member 77 that comes into contact with the above member from the upper direction is mounted on the stationary member 78 via a coil spring 79.

A limit switch 81 for detecting the tip of the pick arm 10 is mounted on a stationary member that is not shown. The limit switch 81 detects the pick arm 10 at a first paper-feed (at which the vibration-absorbing pad 75 is not in contact with the pick arm 10) shown in FIG. 8(*a*).

FIG. 8(*a*) illustrates a state of feeding the paper in the normal mode and where the tip of the pick arm 10 is at a position being detected by the paper-feed position limit switch 81. At this moment as described above, the vibration-absorption pad 75 is not in contact with the pick arm 10. FIG. 8(*b*) illustrates a first paper-feed position in the high-speed mode and a state of feeding the paper at the time of a first re-trial in the normal mode. In this case, the hopper 1 is lifted up by a predetermined amount from the state of FIG. 8(*a*), whereby the pick arm 10 moves upwards from the state of FIG. 8(*a*), and the vibration-absorbing pad 75 is in contact with the pick arm 10. The difference in the re-trial operation between the succeeding mode and the normal mode is only a difference in the running speed of the pick roller 3.

FIG. 8(*c*) illustrates a state of the re-trial operation in the high-speed mode and the re-trial operation of the second time in the normal mode. In this state, the hopper 1 is further elevated compared with the state of FIG. 8(*b*), the vibration-absorbing pad 75 is pushed more strongly onto the pick arm 10 than in the state of FIG. 8(*b*), and the pad push-down member 77 comes in contact with the member at the tip of the pad plate 4 such that the coil spring 79 downwardly urges the pad plate 4. Therefore, the urging force of the pad plate 4 caused by the cylindrically coiled spring 72 is weakened by the urging force of the opposite direction produced by the coil spring 79. The difference between the re-trial operation in the high-speed mode and the re-trial operation of the second time in the normal mode is only a difference in the running speed of the pick roller 3 as in the case of FIG. 8(*b*).

Figure 9:
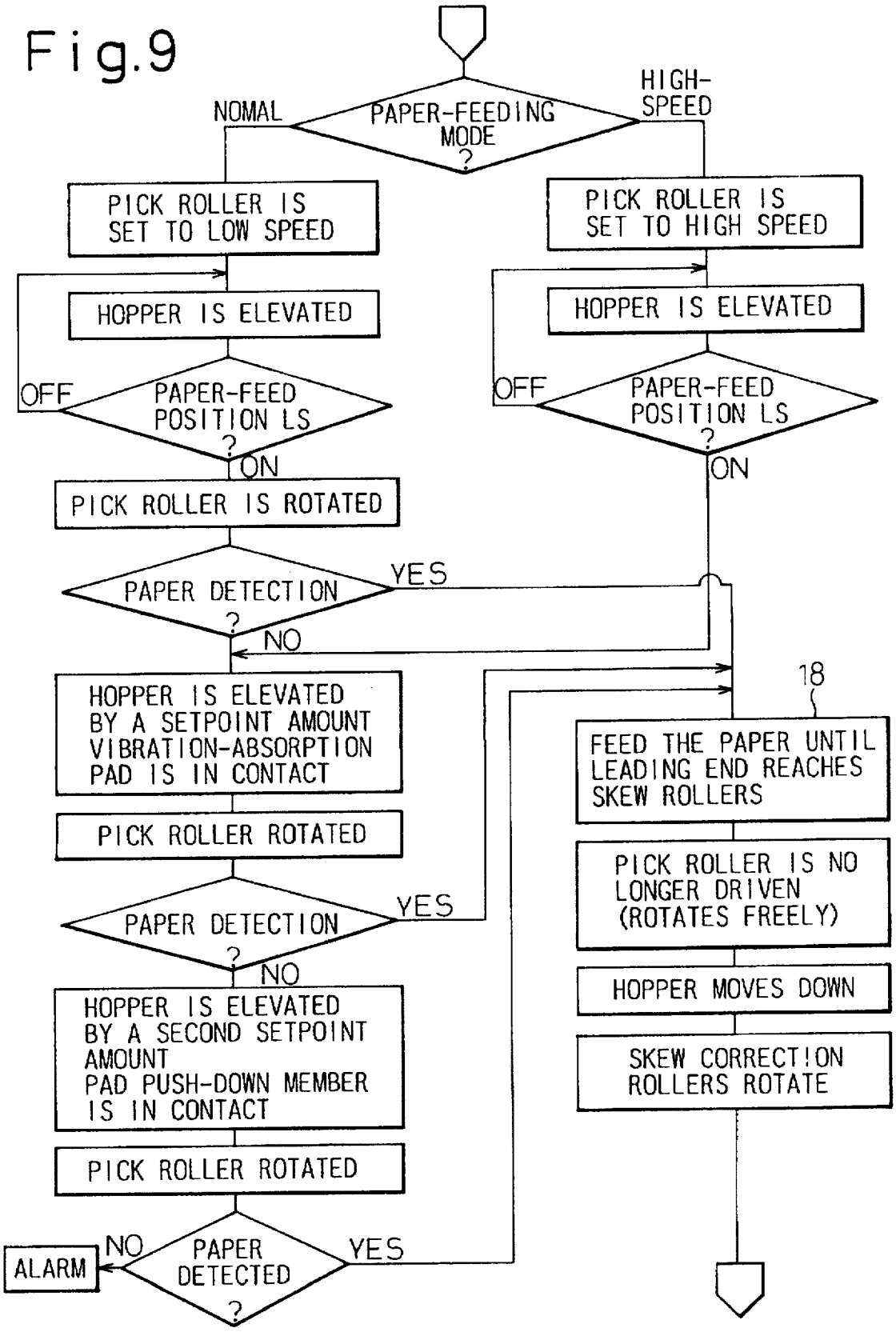
FIG. 9 is a flow chart of control operation according to the eight embodiment.

Next, described below with reference to FIG. 9 is the paper-feeding operation of the paper-feeding device according to the eighth embodiment. When the paper-feeding mode is the normal mode, the running speed of the pick roller 3 is set to the low-speed side, and the hopper 1 rises. The pick arm 10 is moved upwards by the pick roller 3 that is pushed up accompanying the upward motion of the hopper 1 via the papers 1. When the pick arm 10 is detected by the paper-feed position limit switch 81, the hopper 1 stops rising and the pick roller 3 is rotated by a predetermined amount. At this moment, the running speed of the pick roller 3 is that of the measuring side. When the paper is detected at the paper detection step 17 accompanying the rotation of the pick roller 3, the program proceeds to a step 18 and to subsequent steps that will be described later. When no paper is detected, it means that no paper is fed. Therefore, the hopper 1 is elevated by a setpoint amount into a state as shown in FIG. 8(*b*), and the pick roller 3 is rotated again. In this case, the rotation of the pick roller 3 is on the low-speed side. When the paper end sensor (not shown) has detected the paper accompanying this turn, the program proceeds to the motion after the step 18. When no paper is detected, the hopper 1 is further moved up by a second setpoint amount. Thus, the paper-feeding state of FIG. 8(*c*) is assumed. In this state, the pick roller 3 is rotate again. In this case, the rotation of the pick roller 3 is on the low-speed side, too. When the paper is detected due to the rotation, the program proceeds to the operation after the step 18 that will be mentioned later. When no paper is detected, an alarm is produced and the paper-feeding operation is discontinued.

When the paper-feeding mode is the high-speed mode, the rotation of the pick roller is first set to the high-speed side, and the hopper 1 is elevated. Then, the pick arm 10 passes the state of FIG. 8(*a*) where it is detected by the position detection limit switch 81, and the hopper 1 is further elevated by a setpoint amount to assume the state shown in FIG. 8(*b*). In this state, the pick roller 3 is rotate first. This rotation is on the high-speed side. When the paper is detected due to this rotation, the program proceeds to the operation after the step 18 that will be described later. When no paper is detected, the hopper 1 is elevated by the second setpoint amount to assume the state shown in FIG. 8(*c*), and the pick roller 3 is rotated again. When the paper that is fed is detected by this rotation, the program proceeds to the operation after the step 18 that will be described later. When no paper is detected, an alarm is produced and the paper-feeding operation is interrupted. When the paper is detected by the paper sensor 10, the leading end of the paper comes into contact with the skew correction rollers 83 (see FIGS. 11(*a*), 11(*b*). The paper is further fed until it is deflected between the skew correction rollers 83 and the pick roller 3. Thereafter, the pick roller 3 is no longer driven but is allowed to freely rotate. The hopper 1 is then moved down to be separated away from the pick roller 3. Then, the skew correction rollers 83 are rotated to feed the paper 2 to the processing unit such as the document reader or the printer.

Figure 10:
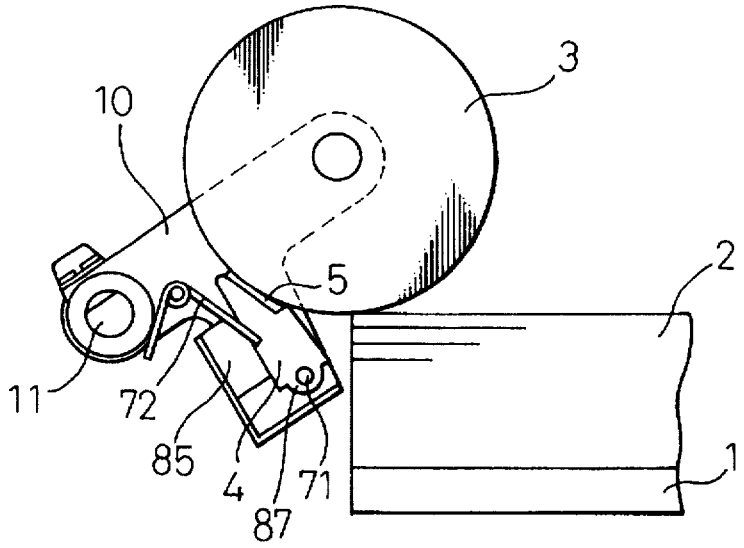
FIG. 10 is a side view of major portions according to a ninth embodiment.

FIG. 10 illustrates a ninth embodiment according to the present invention. A resistance pad 85 made of the same material as the above-mentioned vibration-absorbing pad 75 is provided on the back surface of the pad plate 4. The resistance pad 85 is fastened to a bracket 76 that is secured to the pick arm 10, and is in contact with the back surface of the pad 4.

Though not diagrammed, a highly viscous lubricating agent such as grease may be poured into a pivoted portion 87 of the pad plate 4 to impart viscous resistance against the swinging motion of the pad plate 4, instead of using the resistance pad 85 or together with the resistance pad 85. By giving viscous resistance against the swinging motion of the pad plate 4 by using the resistance pad 85 or grease that is poured into the pivotal portion 87, the double feeding is prevented, particularly, when thick paper is fed at high speeds in the same manner as described earlier. The structure of FIG. 10 may be used together with the structures of FIGS. 8(*a*), 8(*b*), and 8(*c*) or may be used alone.

In the structures of FIGS. 8(*a*), 8(*b*), 8(*c*), the vibration-absorbing pad 75 is provided at a predetermined position so as to be brought into contact with the pick arm 10 as it rises. It is also possible to realize a structure in which the normal mode of FIG. 8(*a*) and the normal mode of FIG. 8(*b*) are exchanged by moving the vibration-absorbing pad 75 up and down. Even in this case, the normal mode and the high-speed mode can be changed over to the re-trying operation in the high-speed mode of FIG. 8(*c*) and to the re-trying operation of the second time in the normal mode by further elevating the hopper 1.

FIGS. 11(*a*) and 11(*b*) illustrate a tenth embodiment according to present invention. In the automatic paper-feeding device equipped with the pick roller 3 and the separator pad 5 and in which the separator pad 5 is so disposed as to obliquely interrupt the passage of the papers that are advancing, the paper that has passed through between the pick roller 3 and the separator pad 5 is fed out obliquely. The skew correction rollers 83 are disposed on an extension of the leading end of the paper that is fed out. The paper fed out from the pick roller 3 comes at its leading end into contact with the nipping portion of the skew correction rollers 83 that are at rest. The pick roller 3 is further rotated to some extent so that the paper 2 is deflected between the skew correction rollers 83 and the pick roller 3. Even when the paper 2 is skewed (tilted) as it is fed out by the pick roller 3, the skewed paper is corrected at its leading end, by the deflection, to be in line with the holding portion of the skew correction roller 83. Then, by rotating the skew correction rollers 83, the paper 2 is fed out without being skewed.

In the device employing the skew-correction mechanism, when the paper is fed at a high speed as mentioned in the section of the mode of operation, a large amount of noise is produced when the paper 2 is stretched between the skew correction rollers 83 and the pick roller 3. In the device shown in FIGS. 11(*a*) and 11(*b*), therefore, the paper-guide surface of a guide member 89 that guides the paper between the pick roller 3 and the skew correction rollers 83 is lined with a buffer sheet 91 made of a sponge or a rubber, and is further stuck with a low-friction film such as of Teflon (Registered Trademark). As shown in FIG. 11(*b*), the upper surface of the buffer sheet 91 must be such that at least a portion thereof has a height with which the paper comes into contact before it is linearly stretched between the pick roller 3 and the skew correction roller 83. With the thus provided buffer sheet 91 comes into contact the paper 2 that is deflected as shown in FIG. 11(*a*) before the paper 2 is stretched between the pick roller 3 and the skew correction rollers 83, whereby a change in the tension is relaxed and the production of noise is decreased when the paper is momentarily stretched and when the paper that is stretched comes into collision with the guide member 89.

Figure 12:
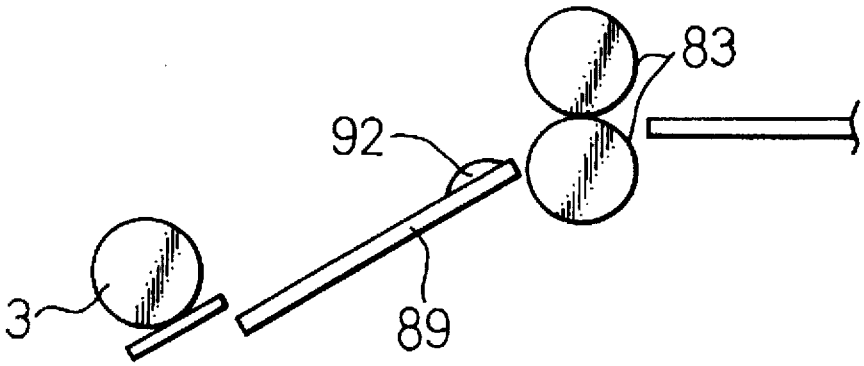
FIG. 12 is a side view which schematically illustrates an eleventh embodiment.

FIG. 12 illustrates an eleventh embodiment in which a buffer member 92 of a semi-circular shape in cross section is provided instead of the buffer sheet 91 of FIGS. 11(*a*) and 11(*b*).

Figure 13:
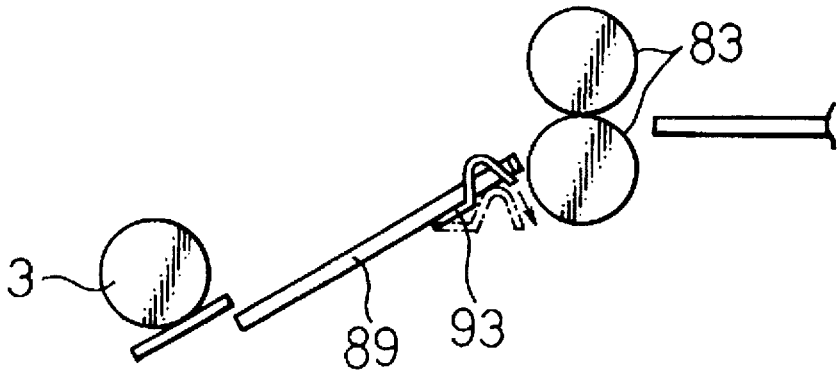
FIG. 13 is a side view which schematically illustrates a twelfth embodiment.

FIG. 13 illustrates a twelfth embodiment in which a buffer spring 93 made of a soft leaf spring is provided to exhibit the same action as the buffer member 92 of FIG. 12. The buffer member 92 of FIG. 12 is made of a sponge or a rubber like that of the buffer sheets of FIGS. 11(*a*) and 11(*b*). The buffer member 92 or the buffer spring 93 is so provided as to guide the bending of the paper 2 between the pick roller 3 and the skew correction rollers 83. As in the case of the buffer sheet 91 of FIGS. 11(*a*) and 11(*b*), the paper comes into contact with the buffer member 92 or the buffer spring 93 so as to be guided in a slightly bent state before it is stretched straight between the pick roller 3 and the skew correction roller 83.

According to the present invention as described above, there is provided an automatic paper-feeding device that feeds the stacked papers in a separated manner by using the pick roller and the separator pad, solving a variety of problems that arise when the papers are fed at high speed and making it possible to feed the papers at a speed faster than the speed of a conventional paper-feeding device of this kind.

Figure 14:
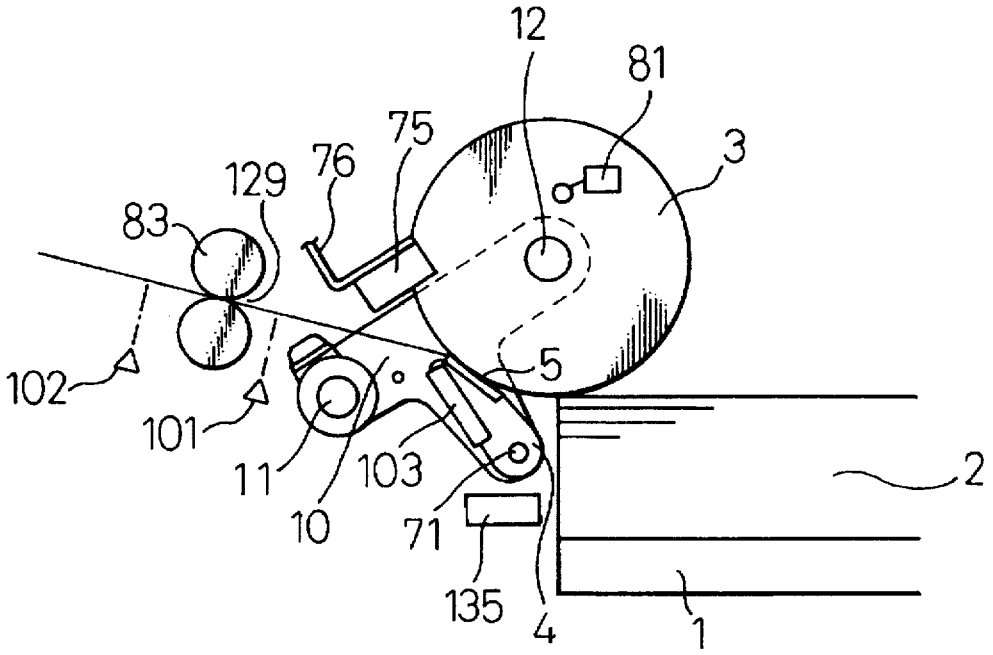
FIG. 14 is a side view illustrating major portions according to a thirteenth embodiment.
Figure 15:
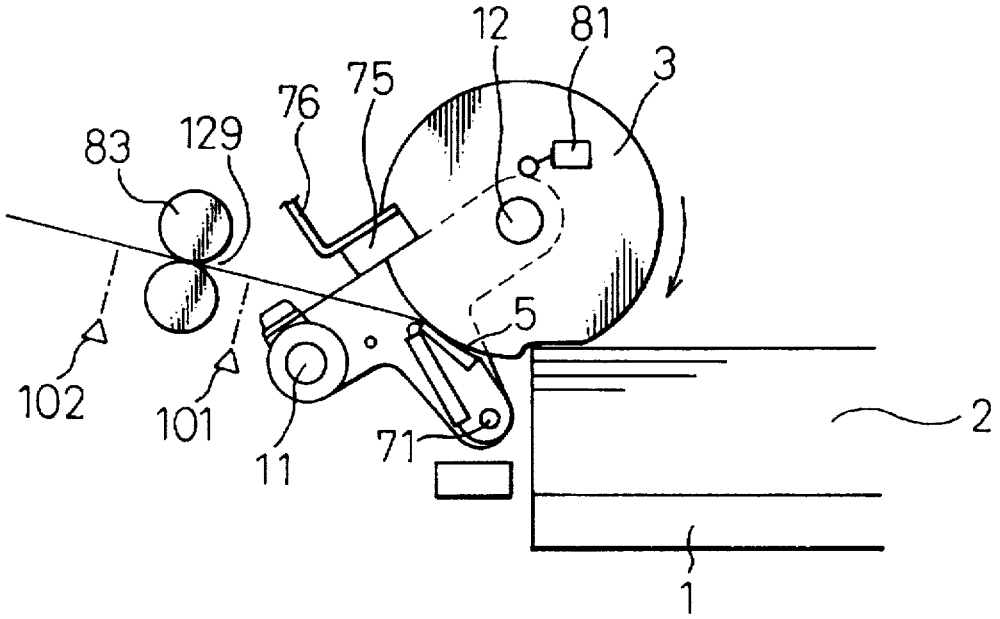
FIG. 15 is a view similar to that of FIG. 14 and illustrating a state of re-trying operation.
Figure 16:
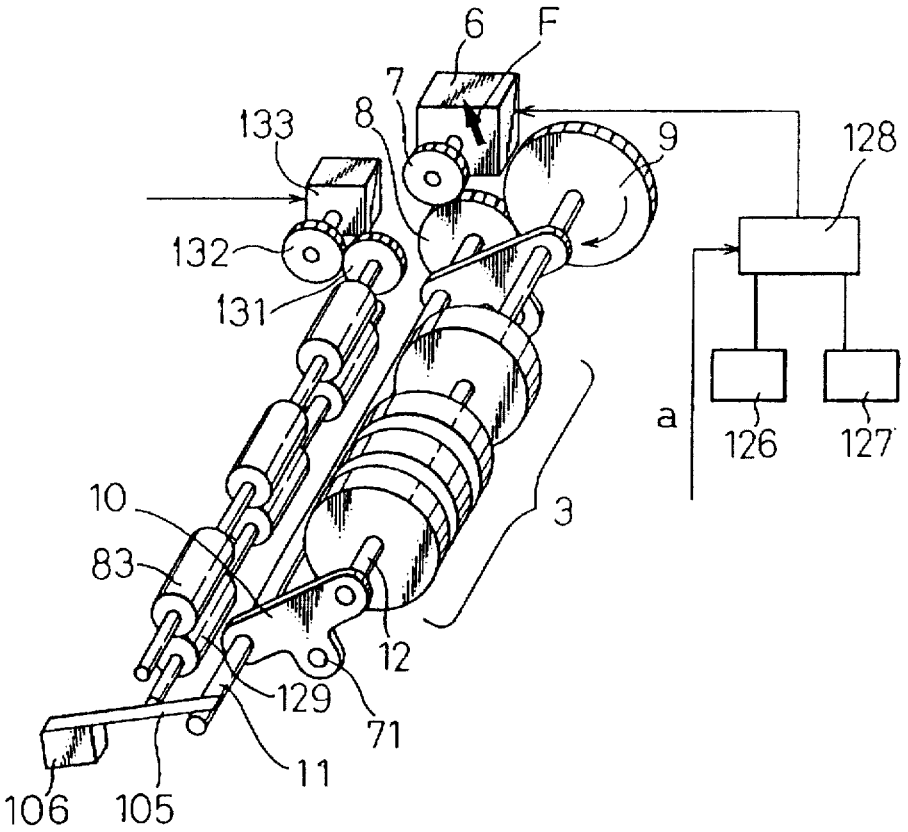
FIG. 16 is a perspective view illustrating major portions according to the thirteenth embodiment.

FIGS. 14 to 16 illustrate a thirteenth embodiment, according to the present invention, wherein FIGS. 14 and 15 are side views illustrating the constitution of major portions and FIG. 16 is a perspective view thereof. The drawings illustrate a pick roller 3, a pick arm 10 which supports the pick roller 3 by a shaft 12, and a skew correction roller 83, wherein FIGS. 14 and 15 illustrate a separator pad 5, a pad plate 4 supporting the separator pad 5, a hopper 1, a paper-feed sensor 101 and a feed-out sensor 102, and FIG. 16 illustrates a drive system of the pick roller 3 and a drive system of the skew correction roller 83.

The pick arm 10 is secured to a pick arm support shaft 11 that is rotatably mounted on a stationary member that is not shown, a pick roller drive shaft 12 is rotatably supported at the end of the pick arm 10, and the pick roller 3 (consisting of a plurality of rollers divided in the axial direction) is secured to the pick roller drive shaft 12. The pick arm 10 has an arm portion that extends downwardly, a pad plate 4 is swingingly supported by a fulcrum pin 71 that is fitted to the end of the arm portion, and the separator pad 5 is mounted on the upper surface at an end of the pad plate 4. The pad plate 4 is urged by a cylindrical coiled spring (not shown) to turn about the fulcrum pin 71 in the clockwise direction in FIGS. 14 and 15, and the separator pad 5 is resiliently pressed by this urging force onto the peripheral surface of he pick roller 3. The pick roller 3 is made of a rubber and the separator pad 5 is made of a rubbery sheet in the same manner as the conventional counterparts. Here, however, the pick roller 3 is made of a relatively soft material and has a relatively large diameter. Onto the back surface of the pad plate 4 is stuck a plate-like damper member 103.

The hopper 1 is moved up and down by a rack-and-pinion mechanism 16*b*. On the hopper 1 are stacked papers 2 such as slips and documents that are to be fed. The pick roller 3 is in contact with the upper surface at the front edge of the stacked papers 2 due to the weight of the pick arm 10 and the pick roller 3.

To an end of the pick arm support shaft 11 is secured a balancing arm 105 that extends in a direction opposite to the pick arm 10, and a balancing weight 106 is fitted to an end of the balancing arm 105. The weights of the pick arm 10 and the pick roller 3 become greater than a proper force of contact that is necessary for drawing out the paper 2. Therefore, the force of contact of the pick roller 3 upon the paper 2 is adjusted by the balancing weight 106 giving a turning force in an opposite direction about the pick arm support shaft 11.

Over the pick arm 10 is provided a vibration-absorption pad or bounce-back stopper 75 as shown in FIGS. 14 and 15. The bounce-back stopper 75 as shown in FIGS. 14 and 15. The bounce-back stopper 75 that is diagrammed comprises a rubber block that is attached to a metal bracket 76 which is secured to the device frame, and the lower surface of the stopper 75 is facing the upper surface of the pick arm 10. A small gap exists between the lower surface of the stopper 75 and the upper surface of the pick arm 10. As the pick roller 3 moves upwards by 0.1 to 0.8 mm, the pick arm 10 comes into contact with the bounce-back stopper 75 (the rubber block 21) to deform it, whereby the upward motion of the pick arm 10 is limited by the repulsive force and downwardly oriented resilient force is given to the pick arm 10.

Referring to FIG. 16, the pick roller 3 is counterclockwisely rotated in the drawing by a drive motor 6 via pick gear 9 secured to an end of the pick roller drive shaft 12, an idler gear 8 supported at an end of the pick arm support shaft 11 which is free to rotate, and a motor gear 7 secured to the output shaft of the drive motor 6. The drive motor 6 has a capacity much larger than that of the drive motor that has heretofore been used for the paper-feeding devices of this kind, and produces a large drive torque and runs at a high speed. The control system of the drive motor 6 is equipped with a means 126 for setting a running speed of the high-speed side, a means 127 for setting a running speed of the low-speed side, and a switching means 128 for switching the setpoint running speed, and either the high-speed drive or the low-speed drive is obtained based upon an instruction from the operator or an instruction from the control program.

The skew correction roller 83 comprises upper and lower groups of rollers that come into contact with each other to form a nipping portion 129, and is driven independently of the pick roller 3 by a second drive motor 133 via gears 131 and 132. The control device gives pulses to the second drive motor 133 to rotate it and, at the same time, gives a predetermined number of pulses to the drive motor 6 that it drives the pick roller 3, so that the pick roller 3 is rotated for only a very short period of time (i.e., for only a very small amount of distance) describing the same rising curve as the skew correction roller 83. In this case, the amount of rotation of the pick roller 3 is such that it is no longer rotated while the skew correction roller 83 is being rotated.

Described below is the operation of the device of this embodiment. The running speed of the pick roller 3 set by the high-speed side setting means 126 has been set to such a speed that the tangential force F of drive of the pick roller 3 pushes up the pick roller 3 when it starts rotating, and the running speed set by the low-speed side setting means 127 has been set to such a speed that will not produce the pushed-up motion.

The papers 2 to be fed are stacked on the hopper 1 that is moved down. At this moment, the pick roller 3 is held at a position at which the pick arm 10 comes into contact with a lower-limit stopper 135. The hopper 1 is then moved up and is stopped at a position at which position detection limit switch 81 detects the pick arm 10.

The papers are fed by rotating the pick roller 3 at the pick position. When the papers are to be fed in the high-speed mode, the pick roller 3 jumps up when it starts rotating. The pick arm 10 is then brought into contact with the bounce-back stopper 75 and is bounced back, and the pick roller 3 readily returns to the normal paper-feed position. At this moment, the pick roller 3 has been accelerated to a certain running speed and no longer floats up. The jumping height of the pick roller 3 is set to be from 0.1 to 0.8 mm as described earlier.

The uppermost piece of paper only is drawn by the pick roller 3 and passes through between the separator pad 5 and the pick roller 3. Owing to the above-mentioned structure, in this case, the pick roller 3 is suppressed from vibrating up and down, and the separator pad 5 is suppressed from vibrating. Therefore, the papers are stably separated and fed even in the high-speed mode. The leading end of the paper that is fed is detected by the paper-feed sensor 101.

When the leading end of the paper is not detected by the paper-feed sensor 101 despite the fact that pick roller 3 is rotated by a predetermined amount, it is judged that paper-feed miss has occurred and the hopper 1 is slightly moved up. The amount of elevation at this moment is the amount with which the pick arm 10 comes into contact with the bounce-back stopper 75 to which is further added a predetermined extra feeding amount. In order to correctly control the amount of elevation of the hopper 1, in this case, the amount of elevation of the pick roller 3 until the upward motion of the pick arm 10 is blocked by the bounce-back stopper 75 after the pick arm 10 is detected by the limit switch 81, is measured in advance and is stored in the controller together with the above-mentioned extra feeding amount. When the hopper 1 moves up by a very small amount that is set as described above, a portion of the pick roller 3 contacting the paper 2 is deformed as shown in an exaggerated manner in FIG. 15, and the force of contact of the pick roller 3 upon the paper 2 increases due to the resilient reaction thereof. In this state, the pick roller 3 is rotated again to execute the re-trying operation. During the re-trying operation, the up-and-down motion has been locked by the bounce-back stopper 75 and the paper 2, and the force of contact relative to the paper 2 has been increased compared with that of during the normal paper-feeding operation. Therefore, an increase frictional feeding force is given to the paper 2, so that the paper is reliably fed.

As the leading end of the paper is detected by the paper-feed sensor 101, the pick roller 3 is rotated by a predetermined amount with the position of detection as a reference and comes into a halt. The predetermined amount at this moment is an amount with which the leading end of the paper comes into contact with the nipping portion 129 of the skew correction roller 83 and the paper is slightly deflected between the skew correction roller 83 and the pick roller 3 as described earlier. In this state, the pick roller 3 is once stopped and, immediately thereafter, the skew correction roller 83 is rotated. The pick roller 3 rotates by a small amount in synchronism with the skew correction roller 83 at a moment when it is rotated. When the skew correction roller 83 is quickly rotated, failure to bite the leading end of the paper tends to occur frequently. When the pick roller 3 is rotated by a small amount in synchronism, however, a thrust is produced momentarily at the leading end of the paper making it possible to prevent the failure of biting the paper by the skew correction roller 83. The leading end of the paper that has passed through the skew correction roller 83 is detected by the feed-out sensor 102. When the leading end of the paper is not detected by the feed-out sensor 102 despite the skew correction roller 83 that started rotating is rotated by a predetermined amount, it is judged that a bite miss has occurred. Therefore, the skew correction roller 83 is once stopped, the skew correction roller 83 and the pick roller 3 are simultaneously rotated, and the re-trying operation is executed.

Figure 17:
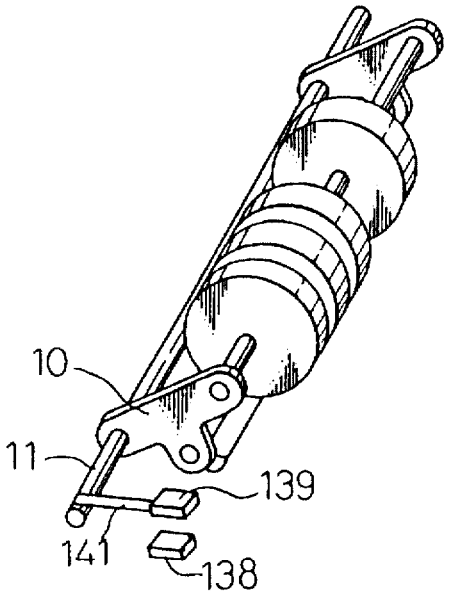
FIG. 17 is a view similar to that of FIG. 16 and illustrating a modification.
Figure 18:
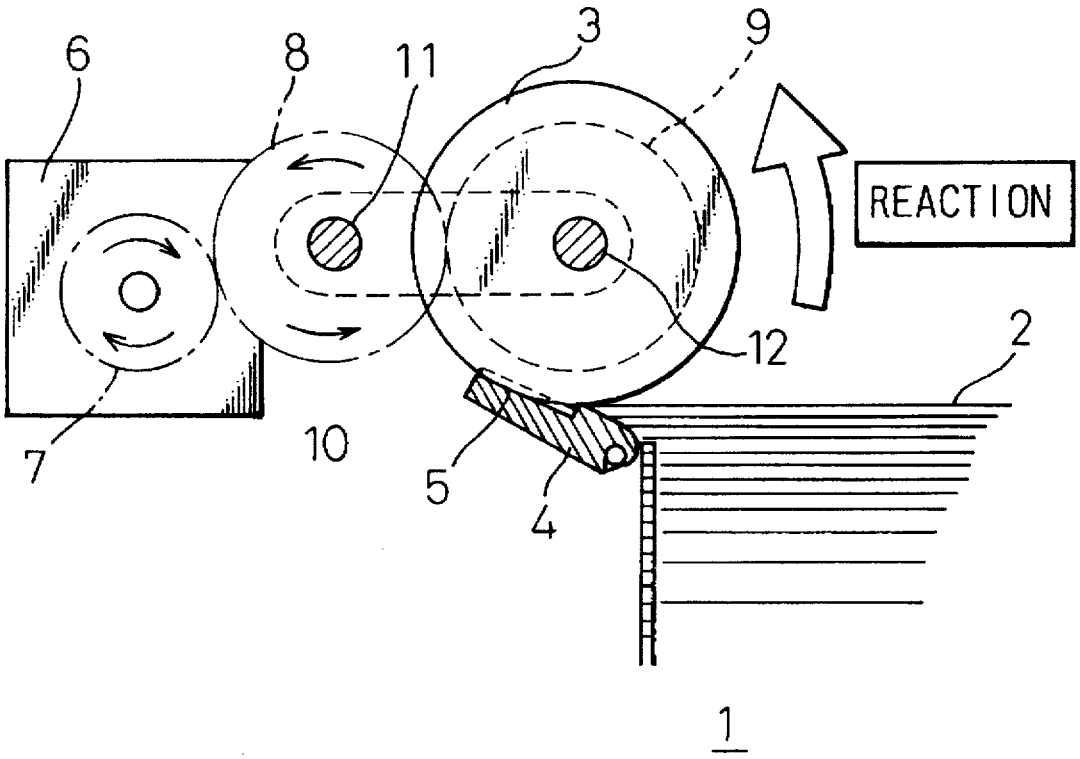
Fig.18 (PRIOR ART)
FIG. 18 is a diagram which schematically illustrates a conventional paper-feeding device.

FIG. 17 is a perspective view illustrating an example of providing magnets 138 and 139 instead of the balancing weight 106 of FIG. 16 as a structure for adjusting the force of contact of the pick roller 3 upon the paper 2. As shown, a bracket 141 is extending from the pick arm support shaft 11 in the same direction as the pick arm 10, and the magnet 139 is attached to an end thereof. Under this magnet 139, the magnet 138 is fixed to the device frame. The magnets 138 and 139 have the same polarity and repel each other. Due to the repulsive force, the pick roller 3 is urged in a direction to be lifted up. By adjusting the gap between the magnets 138 and 139, therefore, the force of contact is adjusted between the pick roller 3 and the paper. Even in this constitution of FIG. 17, the force of contact of the pick roller 3 can be adjusted without using a spring, making it possible to suppress vibration of the pick roller 3 in the up-and-down direction when the papers are being fed at high speeds and to decrease the resonance frequency thereof.

According to the paper-feeding device equipped with the pick roller and the separator pad of the present invention described in the foregoing, it is possible to realize a paper-feeding speed that is strikingly increased compared with that of the conventional devices of the same kind without employing complex and expensive structure or without permitting an increase in the occurrence of paper misfeeds or double feeding.

It is to be understood that the present invention is by no means limited to the specific embodiments as illustrated and described herein, and that various modifications thereof may be made which come within the scope of the present invention as defined in the appended claims.

We claim:

1. A paper-feeding device in which a pick roller is mounted on a pick arm that swings up and down about a pick arm support shaft, comprising:

a drive motor that rotates the pick roller;

a high-speed setpoint means for setting the running speed of the pick roller when the pick roller rotates at a high speed;

a low-speed setpoint means for setting the running speed of the pick roller when the pick roller rotates at a low speed;

a switching means for switching the two setpoint values;

a bounce-back stopper which downwardly repels the upward motion of the pick arm supporting the pick roller when the pick roller rotates at the high speed, and which moves in a position so as to not touch the pick arm when the pick roller rotates at the low speed;

a balancing arm secured at one end thereof to the pick arm support shaft and extending in a direction substantially opposite to the pick arm; and a balancing weight movably and detachably secured to the other end of the balancing arm.

2. The paper-feeding device according to claim 1, wherein the bounce-back stopper has an elastic material such as rubber at a portion where it comes into contact with the pick arm.

3. The paper-feeding device according to claim 1, wherein the bounce-back stopper is provided at such a position as to substantially come into contact with the pick arm to resiliently return it when the pick roller is moved up by 0.1 to 0.8 mm beyond the normal paper-feed position.

4. A method of feeding paper in an automatic paper-feeding device in which a pick roller is mounted on a pick arm that swings up and down about a pick arm support shaft, wherein provision is made of a bounce-back stopper which comes into contact with the pick arm when the pick roller is slightly moved up beyond the normal paper-feed position to limit its upward motion, and when paper-feed miss occurs at the normal paper-feed position, a hopper is slightly moved up beyond the position at which the pick roller is prevented by said bounce-back stopper from moving up, so that the peripheral surface of the pick roller is locally elastically deformed upon coming into contact with the paper, and the pick roller is rotated again to effect the re-trying operation.

* * * * *